US010499739B2

(12) United States Patent
Marks et al.

(10) Patent No.: US 10,499,739 B2
(45) Date of Patent: Dec. 10, 2019

(54) TRANSFORMABLE DRAWER FRONT AND COUNTERTOP LEAF

(71) Applicants: Joel Marks, Sherman Oaks, CA (US); Surapon Arleekul, Sherman Oaks, CA (US)

(72) Inventors: Joel Marks, Sherman Oaks, CA (US); Surapon Arleekul, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 96 days.

(21) Appl. No.: 15/905,981

(22) Filed: Feb. 27, 2018

(65) Prior Publication Data

US 2018/0249834 A1 Sep. 6, 2018

Related U.S. Application Data

(60) Provisional application No. 62/465,702, filed on Mar. 1, 2017.

(51) Int. Cl.

| | |
|---|---|
| ***A47B 88/00*** | (2017.01) |
| ***A47B 88/956*** | (2017.01) |
| ***A47B 13/08*** | (2006.01) |
| ***A47B 88/925*** | (2017.01) |
| *A47B 1/05* | (2006.01) |
| *A47B 88/919* | (2017.01) |

(52) U.S. Cl.

CPC ..... *A47B 88/956* (2017.01); *A47B 13/081* (2013.01); *A47B 13/088* (2013.01); *A47B 88/925* (2017.01); *A47B 1/05* (2013.01); *A47B 2088/939* (2017.01)

(58) Field of Classification Search

CPC ..... A47B 67/04; A47B 46/00; A47B 46/005; A47B 45/00; A47B 88/956; A47B 88/92; A47B 13/081; A47B 13/08; A47B 1/05; A47B 88/944; A47B 2088/955

USPC ..... 312/281, 282, 303, 140.4, 330.1, 291, 312/348.4

See application file for complete search history.

(56) References Cited

U.S. PATENT DOCUMENTS

| | | | | |
|---|---|---|---|---|
| 103,365 A | | 5/1870 | Phelps | |
| 745,693 A | | 12/1903 | Tobey | |
| 1,314,628 A | | 9/1919 | Willman | |
| 1,546,421 A | * | 7/1925 | Wetzel | A47B 88/941 312/303 |
| 1,788,328 A | | 1/1931 | Roberts | |

(Continued)

FOREIGN PATENT DOCUMENTS

| | | | |
|---|---|---|---|
| DE | 102009046035 | * | 5/2011 |
| DE | 202015102256 | * | 8/2016 |
| WO | 02089633 | * | 11/2002 |

*Primary Examiner* — Janet M Wilkens

(57) ABSTRACT

A face/leaf structure can transform functions to selectively expand the usable area of a cabinet countertop or drawer without compromise to the cabinet's other functions. A drawer front is movably attached to a drawer to be either in a normal cosmetic vertical position or in a horizontal position cantilevered from the drawer. The structure may be arranged so that the leaf can be deployed with a single action. The leaf may rise to a same level as the countertop or selectively add exposed and usable horizontal space at a drawer front. Further the leaf can be pulled away from the main surface along with the drawer. This allows usable access to the drawer without stowing the leaf.

18 Claims, 6 Drawing Sheets

(56) References Cited

U.S. PATENT DOCUMENTS

| | | | | | |
|---|---|---|---|---|---|
| 1,887,102 | A | * | 11/1932 | Mathie | A47B 63/02 312/303 |
| 2,221,844 | A | * | 11/1940 | Nonnast | A47B 1/05 108/26 |
| 2,229,320 | A | * | 1/1941 | Balzano | A47B 1/05 108/75 |
| 2,486,966 | A | * | 11/1949 | Mitchell | A47B 63/04 312/303 |
| 2,627,444 | A | * | 2/1953 | Altman | A47B 63/04 312/303 |
| 2,775,501 | A | | 12/1956 | Kyllo | |
| 3,190,712 | A | * | 6/1965 | Fielden | A47B 81/00 312/311 |
| 3,865,447 | A | * | 2/1975 | Patterson | A47B 63/04 312/234.2 |
| 4,709,972 | A | | 12/1987 | LaBudde et al. | |
| 5,947,573 | A | | 9/1999 | Tovar et al. | |
| 6,227,635 | B1 | | 5/2001 | Teppo et al. | |
| 7,429,090 | B2 | | 9/2008 | Salice | |
| 7,708,328 | B2 | | 5/2010 | Doom et al. | |
| 8,328,265 | B2 | * | 12/2012 | Danz | B60R 7/04 296/37.12 |
| 8,348,362 | B2 | | 1/2013 | Candeo et al. | |
| 8,403,190 | B2 | | 3/2013 | Woo | |
| 9,173,488 | B1 | | 11/2015 | Bello | |
| 9,635,771 | B2 | | 4/2017 | Head | |
| 2008/0067901 | A1 | | 3/2008 | Chen | |
| 2016/0325671 | A1 | * | 11/2016 | White | B60P 3/36 |

* cited by examiner

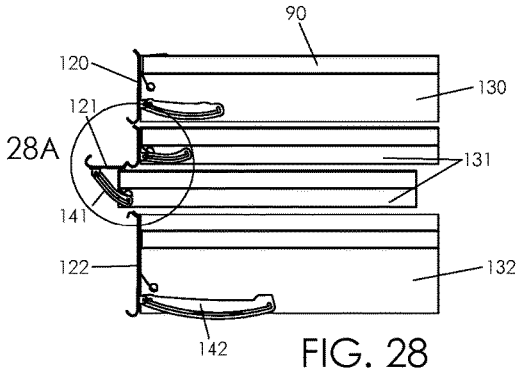
FIG. 28
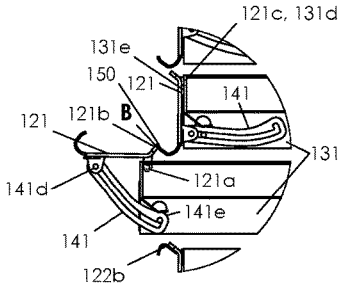
FIG. 28A
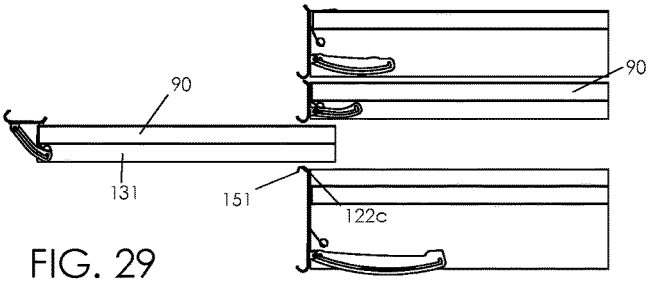
FIG. 29
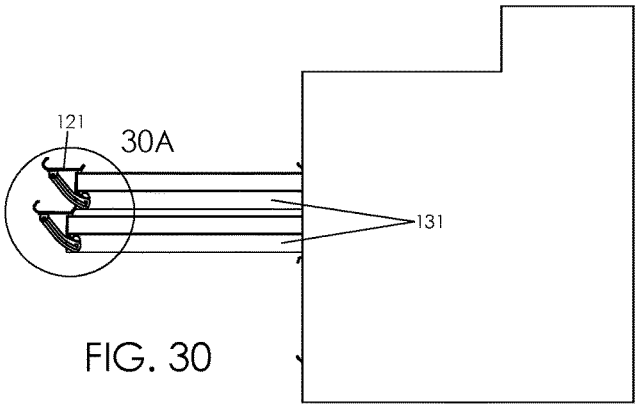
FIG. 30
FIG. 31
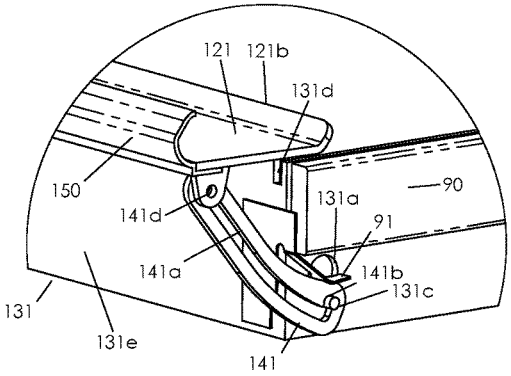
FIG. 32
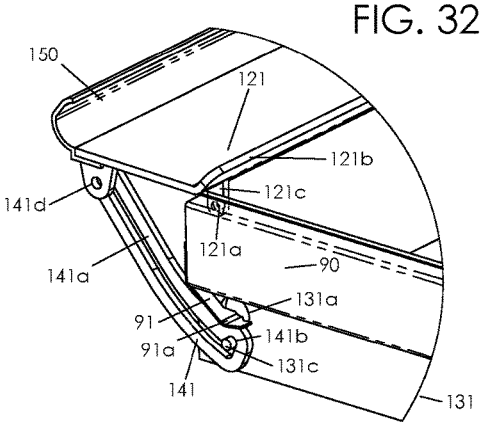
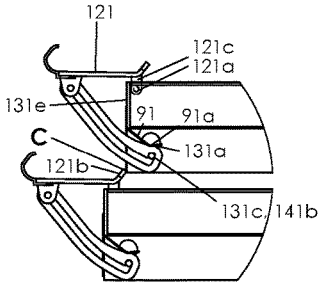
FIG. 30A

TRANSFORMABLE DRAWER FRONT AND COUNTERTOP LEAF

FIELD OF THE INVENTION

The present invention relates to countertop leaf extensions. More precisely, the invention relates to a multifunction leaf in a compact application.

BACKGROUND

Countertop and other leaf extensions are known. They are useful with any countertop or cabinet and especially so when used in a compact environment such as a small apartment, recreational vehicle, tool chest, boat or the like. In one example a leaf may slide out from below a countertop level. This type of leaf makes a drawer below it inoperable when the leaf is deployed since an extended drawer is covered when the leaf is out. Further such a leaf is below the countertop level making the extension vertically isolated from the main surface. Another type of leaf normally hangs downward and folds up from a side of the countertop. For example the leaf or board may hang along one side of the cabinet assembly and fold upward to extend from the countertop. However this hanging type requires an open and well exposed end of the cabinet to function. If a hanging leaf is stowed on a front of the cabinet it would cover and disable all the drawers and doors that would normally be present there. There is presently no solution that does not compromise one or both of the leaf's utility and the cabinet's normally-used other features.

SUMMARY OF THE INVENTION

In a preferred embodiment the present invention includes a structure that can transform functions to selectively expand the usable area of a cabinet countertop. Such expansion is possible while maintaining access to storage space beneath the extension (for example) without the compromises of the structures discussed above. In particular the normal drawers and doors are accessible for any contemplated condition of the extendable leaf. For this purpose the leaf assembly includes a drawer front face that serves a second function as the leaf. The drawer front is movably attached to the drawer box behind it to be either in a normally vertical position or in a horizontal position cantilevered from the drawer. The normally vertical position serves the purpose of providing the cosmetic drawer front that one skilled in the art is familiar with. The structure may be arranged that the leaf can be deployed with a single action without a need for secondary operations. When used as a countertop extension the leaf preferably rises to near or at a same level as the main counter surface. Further the leaf can be pulled away from the main surface along with the drawer. This allows usable access to the drawer without stowing the leaf. Vertically stacked drawers can singly or severally have respective deployable leaves.

BRIEF DESCRIPTION OF THE DRAWINGS

FIG. 4 shows the drawer and face/leaf stowed.

FIG. 5 shows an initial motion to deploy the face toward its leaf position.

FIG. 6 shows a continuing motion of deployment.

FIG. 7 shows the leaf fully deployed.

FIG. 8 shows the leaf deployed with the drawer pulled out for drawer access.

FIG. 28 is a side elevation of the drawers of FIG. 22 with a leaf of a middle drawer deployed and the drawer in a corresponding inward position.

FIG. 28A is a detail view of FIG. 27.

FIG. 29 is the view of FIG. 27 with the middle drawer fully extended open.

FIG. 30 is the view of FIG. 28 with two vertically adjacent middle drawers extended.

FIG. 30A is a detail view of FIG. 30.

FIG. 31 is a front perspective view of a deployed drawer.

FIG. 32 is a rear perspective view of the drawer of FIG. 30.

DESCRIPTION

Figure 1:
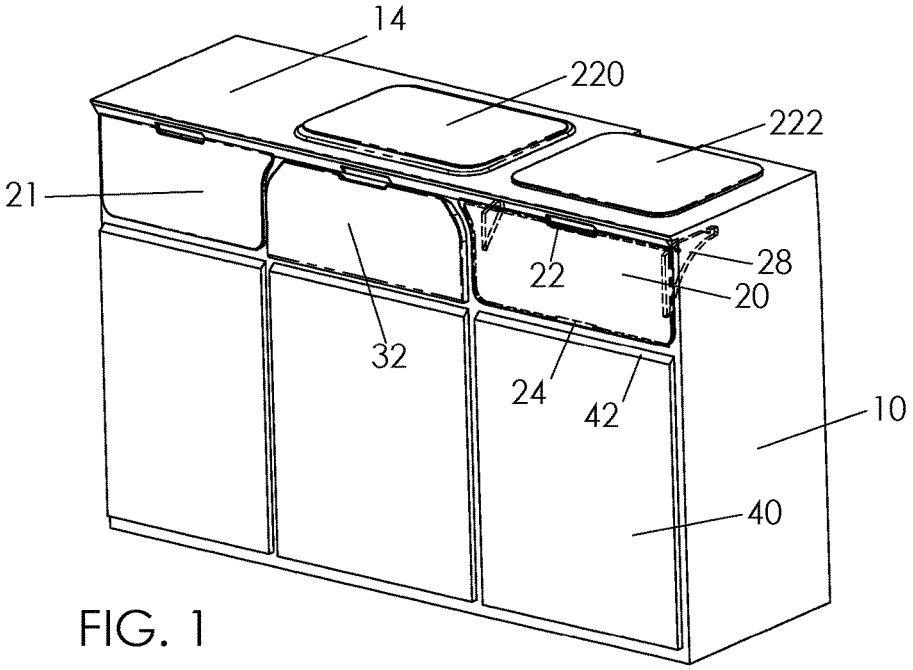
FIG. 1 is a right side perspective view of a preferred embodiment cabinet assembly with face/leaves stowed and drawers closed.

FIG. 1 shows a cabinet assembly including countertop 14 and cabinet 10. The assembly shown is suited for use, for example, in a recreational vehicle (RV). As such an exemplary stove 220 and sink 222 may be fitted as shown. Such appliances may have covers as shown to increase useful counter space. However when one or both of the stove and sink are in use the respective areas are not available for other uses. Then only the open area to the left of these appliances is always clear for use. This type of arrangement is common in compact RV's or other small living areas. One solution is to add a fold up leaf on a side of the cabinet, for example where the numeral 10 is indicating in FIG. 1. However in a compact space this side will not be open and clear. Other fixtures will often be next to the cabinet, for example a tall cabinet, chair, lavatory etc. If the side is open and clear to provide for an entry/exit door then deploying such a single purpose leaf to the right in FIG. 1 for example will at least partly block the door. More generally the cabinet becomes wider from the single purpose leaf.

Another design may have a slide out leaf below the countertop and above a drawer. This leaf covers the drawer any time the leaf is in use. Thus to access the drawer the leaf, and anything on it, must be cleared and leaf closed. In effect the drawer below is not usable while the leaf is in use. Further such leaf cannot practically be at or near the same level as the countertop, so it is not a useful extension of the countertop surface.

Figure 2:
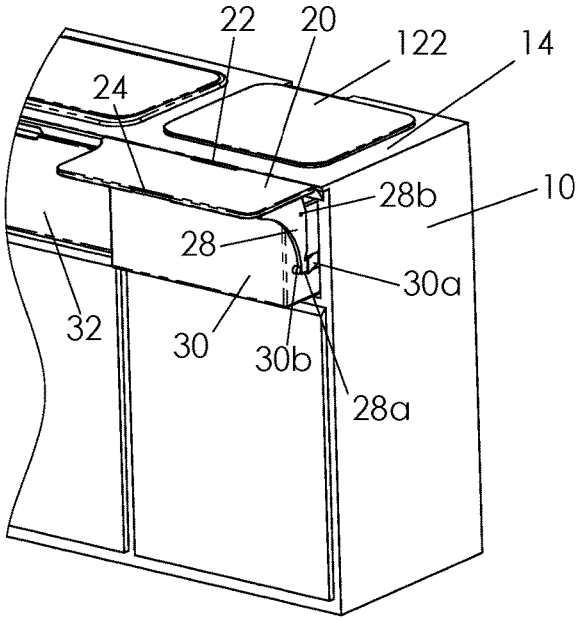
FIG. 2 is a cropped view of the assembly of FIG. 1 with a leaf deployed.
Figure 3:
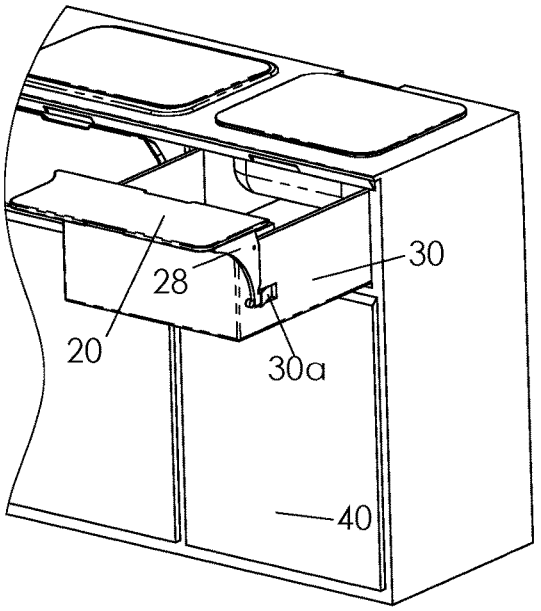
FIG. 3 is the view of FIG. 2 with a drawer opened while a leaf is deployed.

Referring to FIG. 1 through FIG. 3 an example of the present embodiment is depicted in the illustration. In FIG. 1 a front of cabinet 10 has all drawers in the inward position within an interior of the cabinet below countertop 14. In FIG. 3 drawer 30 is extended fully outward. In FIG. 2 drawer 30 is extended partly outward to an extent needed or preferred to support deployed leaf 20. In FIG. 2 it is seen that leaf 20 has moved from a function as a nominally conventional decorative face to transform into leaf 20. As such this element may be referred to as leaf 20, face 20 or face/leaf 20, with such terms referencing the same object and indicative of its multiple functions and respective positions. A top or primary usable surface of leaf 20 is preferably at or near a same level as countertop 14 as shown so that the leaf is a true countertop extension. The levels and contours of the countertop and deployed leaf should be close enough that items on one can readily be slid or moved to the other. Preferably the exposed face of face/leaf 20 is a material suited for countertop use. For example it may be a laminate such as Formica. Or the face/leaf may be a resin composite material. Other materials not limited to wood or metal or stone may also be used. As shown there are preferably two layers to a front portion of a drawer, an inner layer being drawer front panel, or drawer front, that bounds a box of the drawer from a front side at the leader location for drawer 30 in FIG. 2. A second outer layer is at the leader location for face/leaf 20 in FIG. 1. See also FIG. 4. In this regard the construction of the drawer is familiar in cabinetry, having the drawer box including four sides with a box front panel and a separate element of a decorative face plate on the front panel that substantially hides the drawer box from a front view when the drawer is closed. However the face plate can assume a second novel function of being a practical leaf extension while the drawer remains a normally useable four sided box with a fixed front panel bounding the box of the drawer from the front side for any face/leaf position. In the limits of being fixed the front panel may have incidental possible motion in relation to the drawer box, for example through fastener tolerance or the other fittings.

Figure 4:
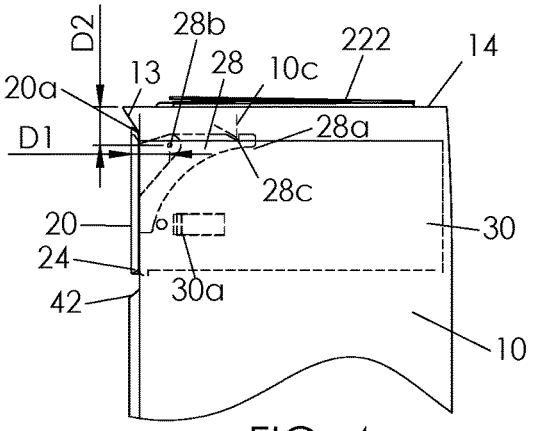
FIGS. 4 to 8 are cropped end elevation views of the cabinet assembly, with the drawer shown hidden, showing an operational sequence to deploy the leaf.

Face/leaf 20 is preferably pivotally attached to drawer 30. The drawer front panel is covered or hidden by the face/leaf in the stowed position and exposed frontward in the deployed position. When deployed leaf 20 is external to and in majority upwardly exposed beyond both a front of drawer 30 and a front of cabinet 10. For example preferably greater than 80% or preferably 90% of the leaf area is exposed upward without blockage from the attached drawer or countertop, while this exposure is at or near 100% in the drawings. Other exposures may be used. Similarly a majority of an area of deployed leaf 20 cantilevers outward from a front of the drawer, this being about ⅔ as shown in FIG. 4 or more than 80% in the case of FIG. 28A discussed later. Leaf 20 greatly expands the useable area in front of sink 222 which area may be used for food preparation or holding dishes to be washed. However while the leaf is in use there can be a need to access the contents of the drawer below. In FIG. 3 drawer 30 is extended from a front of the cabinet in a normal way, see also FIG. 8. Leaf 20 moves from adjacent in FIG. 2 to being spaced from the front of the cabinet, the spacing of a rear edge of the leaf being close or the same as the distance the drawer has moved outward. Drawer 30 is nearly fully exposed inside for access while objects upon leaf 20 can move with the drawer and thus do not need to be separately removed from the leaf to use drawer 30. A limited rearward leaf overlay of the drawer past the drawer front panel or drawer front adds leaf area while retaining reasonable access to the drawer beneath the rearward overlay part. Once the drawer contents are accessed the drawer is moved back to the position of FIGS. 2 and 7 if the leaf is still in use, or fully stowed as FIGS. 1 and 4 if desired. The face/leaf may be attached to a drawer with limited extension as may be the case with a drawer in front of a sink or stove. Further a face/leaf may be configured as a false front or equivalent that is attached to the cabinet directly or through a drawer like structure, with the face/leaf operating in the manners disclosed herein, for example deploying to be level with the countertop.

Face/leaf 20 comprises a size as described by a vertical direction in FIG. 4. This size is preferably near a height of drawer 30 when used with a single drawer, this being similar to a practical size of a decorative face plate. Size in this respect may be called an extent dimension or extent of a face/leaf element.

Figure 12:
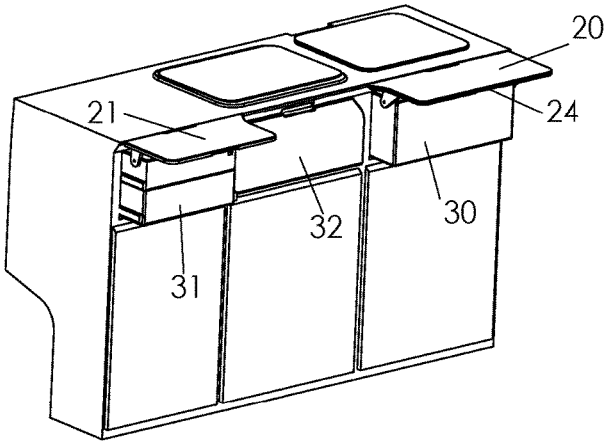
FIG. 12 is a left side perspective view of the cabinet assembly with a double stacked left drawer, the right and a left side leaves deployed.
Figure 13:
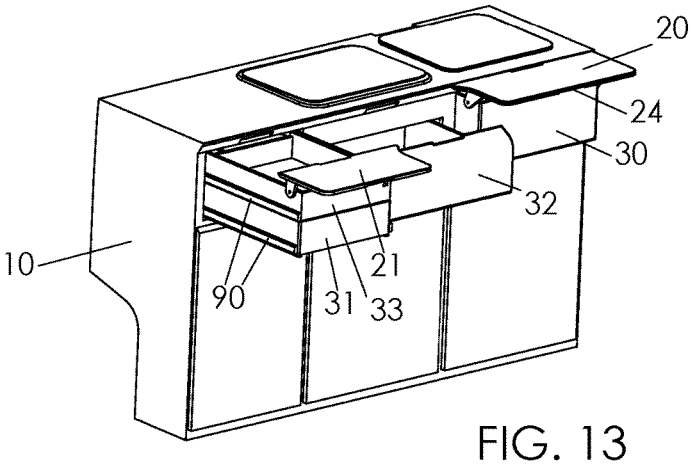
FIG. 13 is the view of FIG. 12 with the left and a center drawer opened.
Figure 15:
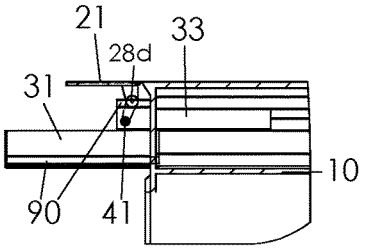
FIG. 15 is a detail view, partly in section, of an assembly with a leaf and dual drawers including an alternate embodiment leaf holding structure, with the leaf deployed and lower drawer open.

Seen in FIG. 13 there are four separate exemplary drawers. The left drawers 31 and 33, FIG. 13, are shallow, vertically stacked and correspond to face 21 in FIG. 1. Center drawer 32 does not include a leaf function as shown, having only a face. However drawer 32 may have such multi function face/leaf. With two end leaves deployed the central area remains open for the user to work adjacent to the main countertop and be surrounded by two useful leaves effectively forming a U shaped countertop. Working in this position maintains ready access to the countertop. It also preserves room in a walkway in front of the cabinet behind the user since the leaves are preferably of an extent dimension as described above, about 9 inches in exemplary FIG. 8. FIGS. 12 and 13 shows center drawer 32 closed and opened respectively with both leaves deployed.

Figure 5:
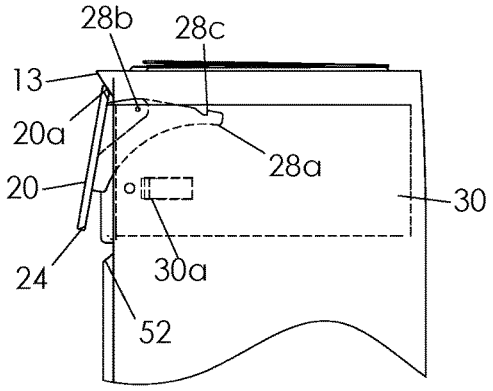
Figure 14:
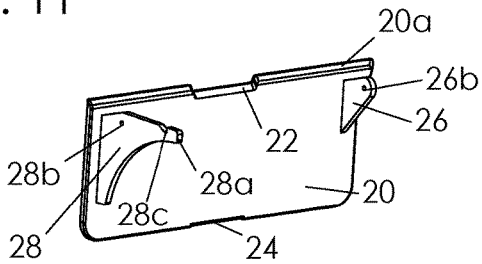
FIG. 14 is a rear perspective view of a drawer face/leaf with attaching structures.

To deploy leaf 20 the drawer is pulled from a bottom area at recess 24 or equivalent handle feature, FIGS. 5 and 14. One skilled in the art will be familiar with other handle features that are within the scope of the disclosure. For example a magnet, detent, or other friction retainer discussed below may hold face 20 from rattling. To initiate the opening action the user may pull at recess 24 and push with a thumb above this area. This is an intuitive motion when the intent is to rotate the face into the leaf position. Face/leaf 20 is pivotally attached to drawer 30 through hinge arms 26 and 28 at pivots 28*b* and 26*b*, FIG. 14. Face/leaf 20 includes upper edge 20*a*. Countertop 14 or cabinet 10 includes forward edge 13. These features automatically interact through a cam action to coordinate the leaf deployment to the drawer opening.

Figure 6:
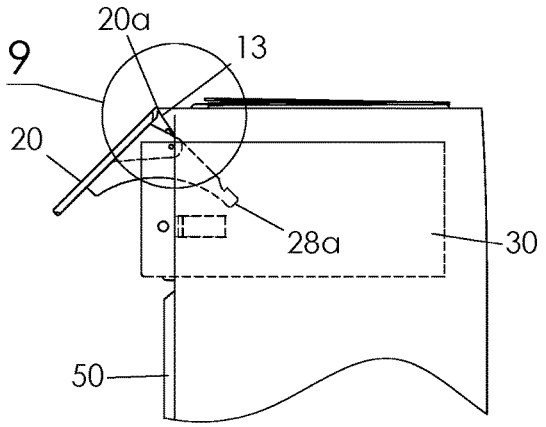
Figure 7:
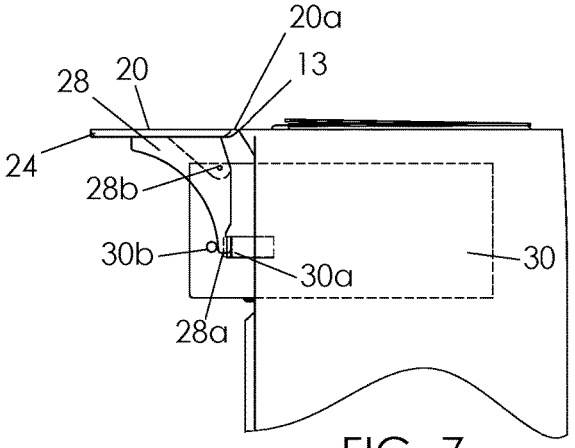
Figure 8:
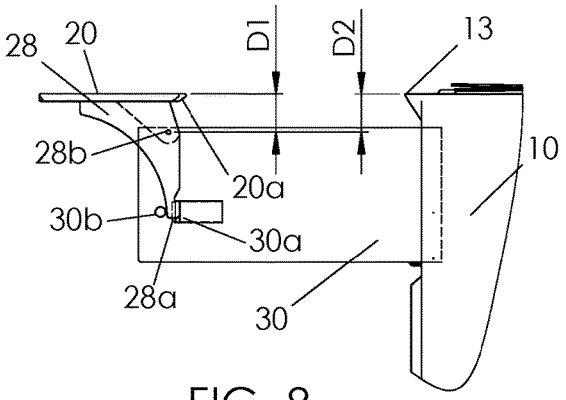
Figure 9:
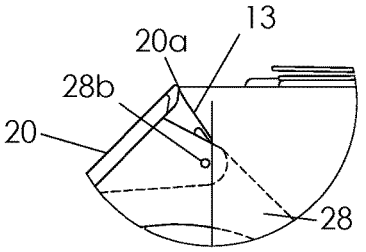
FIG. 9 is a detail view of a cam link between the leaf and countertop during deployment.
Figure 10:
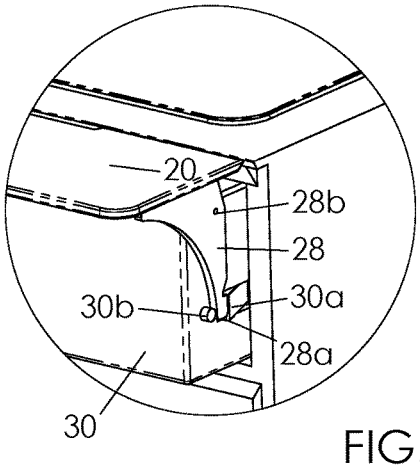
FIG. 10 is a detail perspective view of a structure to hold the leaf deployed.

The deployment sequence is shown in FIGS. 4 to 7. In FIG. 4 the assembly is stowed. Face 20 acts in a conventional way as a normally cosmetic cover for drawer 30. In FIG. 5 face 20 may be called face/leaf 20 since it is no longer just a cosmetic cover. Face/leaf 20 is pulled at lower recess or area 24. Note the illustrated chamfer 52 on door 50 below. This facilitates access to recess 24. As face/leaf 20 rotates about pivots 26*b* and 28*b* upper edge 20*a* slides along front edge 13 in the cam action. This motion continues through FIGS. 6 and 7. In FIG. 7 edge 20*a* abuts a front of the cabinet at edge 13, or generally abuts a front of the cabinet. Drawer 30 is preferably forcibly moved to the deployed leaf supporting position of FIG. 7 of the drawer as the leaf is moved. The cam angle between edges 13 and 20*a* ensures that face/leaf 20 does not get wedged or jammed under the countertop as it causes drawer 30 to partly slide or translate outward. The user need not actively position the drawer. In the deployed position preferably resilient detent 30*a*, see also FIG. 10, latches tab 28*a* of hinge arm 28 to hold the deployed position. Detent 30*a* may be made from strip spring steel for example. Post 30*b* provides an upper limit stop to the leaf position. It is not required that edges 13 or 20*a* be continuous along a length of the respective parts. For example edge 13 may be in majority vertical with only portions being angled as shown in FIG. 4. The same applies to edge 20*a*. The angled or cam portions can be limited to narrow ramps that mate at or similar to the indicated angles. The cam action at edges 13 and 20*a* or any other structure that provides this function is preferred but not required for the leaf system to function. A further advantage of the angle at edge 20*a* is a larger leaf area when deployed. In FIG. 4 it is seen that edge 13 extends forward past edge 20*a*. This overlap is used as seen in FIG. 7 where the leaf extends farther to the left than it would if edge 20*a* were truncated vertically (flat). Other cam actions and locations are contemplated. For example the cam action described with respect to edges 13 and 20*a* may be provided instead by selective pressing between end 28*c* of hinge arm 28 and a rib or tab of an interior of cabinet 10, for example below a location of tab 10*c*, FIG. 4. With alternate cam locations, or no cam actions, the shapes of edges 13 and 20*a* may be less restricted. With no cam actions the positioning of each of drawer 30 and leaf 20 may be done by direct hand actions As discussed earlier the deployed leaf is substantially co-planar with, at, or near the same level as countertop 14. Near the same level is near enough that objects can be normally slid between the leaf and the countertop. For example a height difference of less than ¾ inch may be considered near a same level, with such difference preferably less than ½ or ¼ inch. With a ramp or sloped transition as discussed below for lip 120*b* in FIG. 27 the leaf and countertop need not be at an exact same level to provide the sliding or other simple moving action. To enable this hinge arms 26 and 28 are elongated between respective pivots 26*b*, 28*b* and the face or top of leaf 20. In FIG. 4 D1 is a perpendicular distance between pivot 28*b* and a face of leaf 20. D2 is a perpendicular distance between the pivot and countertop 14. These distances are similar or the same. Thereby as seen in FIG. 8 when leaf 20 is deployed D1 is oriented vertically and is the same as D2 to provide the leaf at or near a same level as countertop 14. To stow the leaf from the deployed position of FIG. 7 resilient detent 30*a* is pressed to release tab 28*a* of flange 28. See also FIG. 2. Leaf 20 of FIG. 7 then transforms into face 20 of FIG. 4.

Preferably a detent or light pressure catch holds drawer 30 slidably in this partly extended position so that the leaf does not move toward the drawer-open position of FIG. 8 except when desired. For example drawer glides used with drawer 30 may have a feature to hold this leaf support position. Further there may be a magnet or other holding feature for example between edges 13 and 20*a* to selectively hold leaf 20 against countertop 14 in the deployed position.

Figure 11:
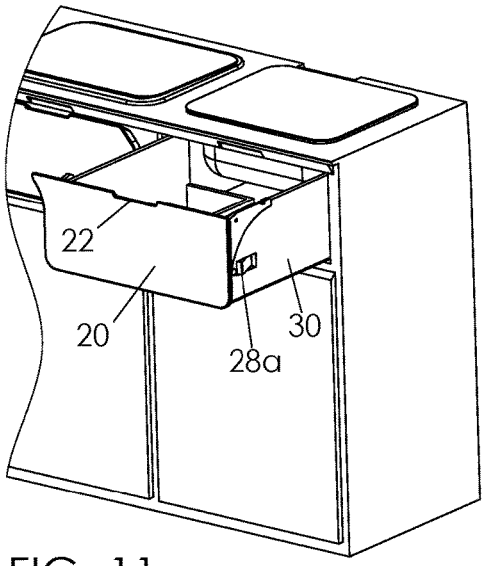
FIG. 11 is a cropped perspective view of the cabinet assembly with the drawer extended in a conventional manner.

The drawer may be selectively held in the closed position of FIG. 4 by a friction, roller, magnetic catch or equivalent. To open the drawer in a conventional manner a user may pull at upper pull or recess 22, FIGS. 11 and 14, to overcome a force of the catch. Other handle structures in this area may be used. By pulling outward from a top of face 20 the face will not rotate, rather it will just remain in its normal vertical position as the drawer slides out.

Alternately the drawer may be opened from lower recess 24 or equivalent handle structure. See FIG. 5. In this context a magnetic catch or similar may hold a bottom of face 20 to a front of drawer 30. As shown hinge arm 28 includes detent catch 28*c*. This catch can normally engage a tab 10*c*, FIG. 4, of cabinet 10 to hold drawer 30 in the stowed position, with catch 28*c* working in addition to or instead of the friction catch described above. By this opening method a user can deploy the leaf with a single continuous hand motion through the positions of FIGS. 4 to 7. However if it is desired only to open the drawer to the position of FIG. 11 then the user will just continue to pull on face/leaf 20 with the face/leaf likely remaining at an intermediate angle similar to that of FIGS. 5 and 6 through this action.

Preferably there is a soft pivot resistance for face/leaf 20 on drawer 30 near the pivoted positions of FIG. 5 or 6 so that once optional catch 28*c* is released face/leaf 20 will pivot to and hold these partially pivoted states. Face/leaf 20 can then serve as a pull handle for opening drawer 30. With drawer 30 is opened for access, and a leaf not needed, the user merely lets go and the face/leaf falls to the vertical position of FIG. 11 to transform back into being a decorative drawer face. If catch 28*c* is used then upper pull or recess 22 is not required to be used although it may be used as the handle for the later drawer opening action if desired. In this example where the leaf is not deployed face 20 of FIG. 4 is pulled up at recess 24 only to disengage catch 28*c*. Then the drawer is pulled open at recess 22 or 24.

In a further variation face/leaf 20 may be spring biased toward the stowed position of FIG. 4. Pulling at recess 24 will then provide the full drawer opening cycle whereby the spring force holds the face/leaf against the drawer as the drawer is opened. If it is intentionally pivoted upward against the spring force then the leaf is deployed. The spring may be a gas damper type so that the leaf will not slam downward when stowed. Other combinations of latches, detents or other selectable holding structures may be used to operate the system. The exemplary application for the transforming leaf is in an RV. It is useful for any application where space is limited including portable cabinets, boats, small houses, mobile homes or even large areas where additional counter space is desired. In a non-mobile environment there may be limited or no need for catches or other selective holding structures since the parts will not be prone to unintentional motion.

FIGS. 15 to 20 show a compact dual shallow drawer embodiment with leaf 21 preferably being a face covering the front of both drawers in the stowed position. Upper drawer 33 is slidably mounted to cabinet 10 above lower drawer 31. As shown in most the Figures drawer slides 90 for each respective drawer are attached to each drawer and interior cabinet sides. With each drawer independently mounted to cabinet 10 the drawers are stable and secure. Optionally one drawer may be slidably mounted to the other, for example upper drawer 33 slidably supported atop the sides of lower drawer 31 while lower drawer 31 is slidably mounted by slides 90 to interior sides of cabinet 10.

Figure 16:
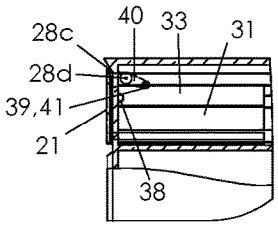
FIG. 16 is the view of FIG. 15 with the leaf stowed and drawers closed.
Figure 18:
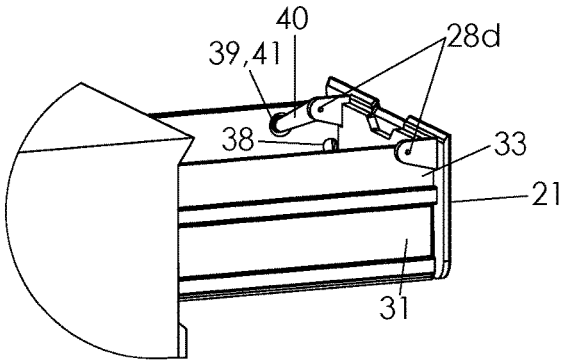
FIG. 18 is a rear perspective view of the assembly of FIG. 17.
Figure 19:
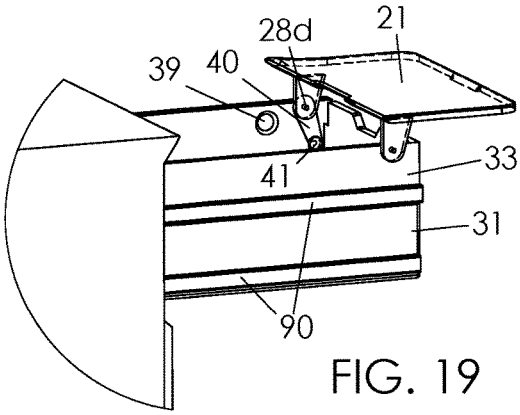
FIG. 19 is the view FIG. 18 with the leaf deployed.

Leaf 21 covers both drawers when stowed, FIGS. 16 and 18. The leaf is pivotally mounted to upper drawer 33 at pivots 28*d*. A leaf holding structure should be sturdy while holding a leaf that cantilevers a distance substantially farther than a height of the shallow drawer 33 to which the leaf is fitted and wherein a majority of the leaf is cantilevered beyond the drawer. As shown leaf 21 is extended about twice the dimension of this drawer height, thus having an extent of about two drawer heights plus any vertical space between the drawers. A shallow drawer may be for example an enclosure between 1.5 to 3 inches high. Accordingly a compact holding structure body 40 suited to the shallow drawers is shown, FIG. 20. Body 40 is preferably bendable, for example made of spring steel strip. Body 40 is preferably rigidly mounted to flange 28*c*. At a distal end is knob or catch 41 or equivalent structure, shown hidden in FIGS. 17 and 19. In the stowed position of FIGS. 16, 17 and 18 knob 41 is held in recess 39 of the drawer sidewall. Pulling up on leaf 21 causes knob 41 to slide out of recess 39 as the knob moves up the ramp of angled confines of recess 39. Body 40 flexes inward away from the sidewall to then slide knob 41 forward along the sidewall toward a secure mating in opening 38 of the drawer sidewall. Knob 41 snaps into the position of FIG. 19 to hold the leaf deployed. To release the leaf, knob 41 is pressed from outside the drawer at opening 38 to cause body 40 to flex and disengage the knob from the sidewall. Drawer 31 may slide upon an enhanced extension slide 90 whereby in FIG. 15 the drawer extends a maximum further out than drawer 33 to expose more of drawer 31.

Figure 13B:
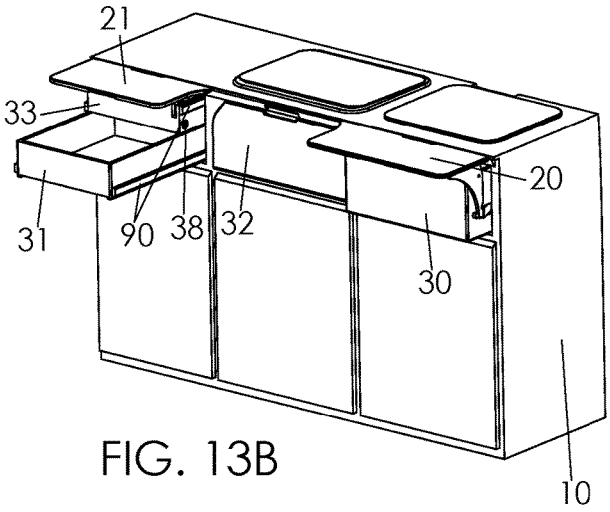
FIG. 13B is a alternate perspective view of the cabinet assembly of FIG. 13 with a left and right drawers opened.
Figure 17:
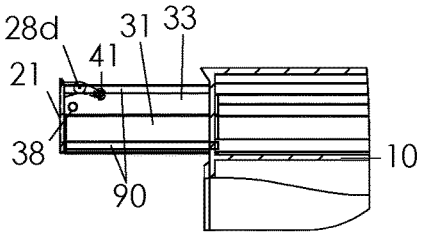
FIG. 17 is the view of FIG. 15 with both drawers open and the leaf stowed.

The distance between pivot 28*d* and knob 41 is a torque arm available to hold the leaf. The torque arm is about an axis across the width of the drawer, into the page of FIG. 16. The body flexes in a direction parallel to the torque arm axis, also into, or out of, the page of FIG. 16. Consistent with free motion of knob 41, the torque arm can be near to the full height of drawer 33 while the knob remains above, or mostly so, a bottom of the drawer during its motion. As shown the present holding structure is internal to the drawer sidewall. Therefore it does not interfere with upper drawer slide 90, FIG. 13B. The drawer can thereby be directly mounted at slide 90 to a sidewall of cabinet 10. Optionally a small vertical partition of drawer 33 may be included inside of body 40 adjacent to the structure such that it would block a view thereof in FIGS. 18 and 19 but not substantially intrude on the drawer space. This may prevent interference with contents of the drawer, especially if the drawer is filled up.

Optionally body 40 may be adjustable by limited pivoting about flange 28*c*, as suggested by the rounded top of body 40. Such adjustment would allow for accurate fitting to a cabinet when tolerances may affect the angular position of leaf 21.

Figure 20:
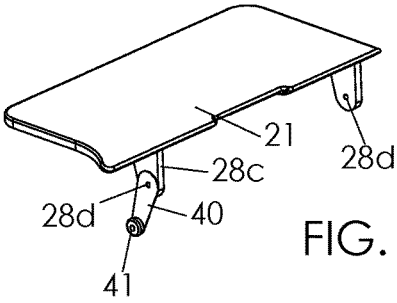
FIG. 20 is a perspective view of a leaf element including the alternate embodiment leaf holding structure.

Comparing the holding structures of FIGS. 3 and 20 it is seen that the latter is likely to be less visible which may be preferable. This is especially true for shallow drawers as shown in FIGS. 15 to 19. Holding structures discussed above include tab 28*a* and body 40. Each can apply a torque to the leaf through an arm to hold the leaf in the deployed position. Stay 140 discussed below also is a holding structure that provides for a holding torque.

Figure 21:
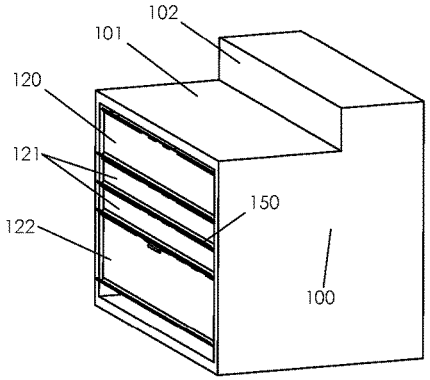
FIG. 21 is a front perspective view of a an exemplary tool chest including a further embodiment drawer and face/leaf system according to the invention.
Figure 22:
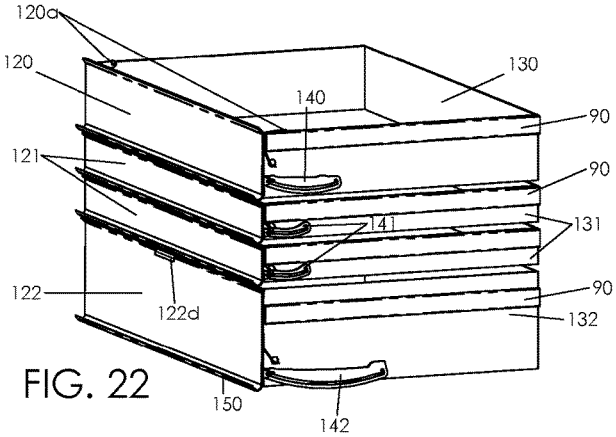
FIG. 22 is the tool chest of FIG. 21 with the supporting cabinet not shown to expose the drawers.

In FIGS. 21 to 32 further embodiments of the invention are shown in a context of a tool chest or cabinet or equivalent application, which may be called a chest here for convenience. A tool chest 100 of the type shown normally has sliding drawers that contain hand held items or other portable implements. The tool chest may have a top surface as shown or it may be hand carried with a handle on top with or without a horizontal top surface. As seen in FIG. 21, there is no excess of horizontal space to lay out in-use tools or implements, to be called tools in this description for convenience. It is common that top surface 101 becomes cluttered and disorganized with various tools from the drawers of the chest, or there may be no top surface at all with the hand carried tool chest. In the typical case that a top cabinet portion 102 is present there is even less horizontal space for lay out. There are known attempted solutions for adding horizontal area to a tool chest. For example a pivoting or sliding leaf may be to a side of the cabinet or above or between drawers, in either case being below a top of the cabinet. However a side leaf adds to the width of the cabinet thus further cluttering a work space. Further, tools on a side leaf are not accessible next to where they are stored, and not at all from an opposed side. A leaf that slides above a drawer requires being cleared to access contents of the drawer immediately below such leaf. This access issue is similar to the earlier discussion regarding the RV style cabinet, and any description below may apply to the RV type cabinet or other storage devices.

As disclosed herein a solution includes providing a horizontal layout surface for one or more of the drawers. As with the preceding RV style cabinet, this horizontal surface is provided with minimal or no compromise to other functions of the tool chest. One or several or all drawers may include the deployable leaf, as shown all drawers of chest 100 have such a leaf.

Figure 27:
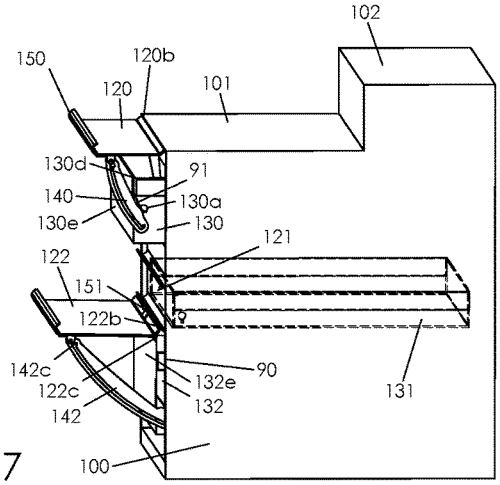
FIG. 27 is a perspective side view of the tool chest of FIG. 21 with upper and lower drawer leaves deployed.

With top leaf 120 of top drawer 130, FIG. 27, the top chest surface 101 can be expanded. With any tool chest leaf, for example bottom leaf 122, such leaf can naturally be associated with the category of tools stored in its associated drawer. In particular a group of tools that is in immediate use for a task can be laid out on the leaf. In a simple example if a job requires a 12*mm* and 14*mm* socket for ongoing use these tools can rest on the leaf of the drawer that contains sockets. A screwdriver may also be needed for the present job. That tool can be laid out on the leaf of a drawer that contains various screwdrivers. Or all the presently needed tools from various drawers can be laid out on a single deployed leaf. The tools are now immediately accessible on the leaf while they are less likely to end up scattered on other horizontal surfaces such as cluttered bench tops or car fenders. When the task is finished the tools are stored, leaves stowed, and the chest reverts to a conventional appearance.

In the leaf-stowed condition the drawers all independently slide out and in a familiar and expected manner. However when a leaf other than the top leaf is deployed the laid out tools thereon may interfere with opening an above adjacent drawer. Absent a solution it would be required to remove the laid out tools and possibly also stow the leaf to open the above drawer. According to the structures and functions shown herein this clearing action is not needed. Instead there is preferably a lock out system that prevents an upper drawer from over riding an adjacent lower one when the lower leaf is deployed. As discussed in detail below, when a first drawer is pulled out atop a second drawer that has a deployed leaf, the second drawer will open with the first. The tools on the second drawer leaf remain undisturbed.

Figure 23:
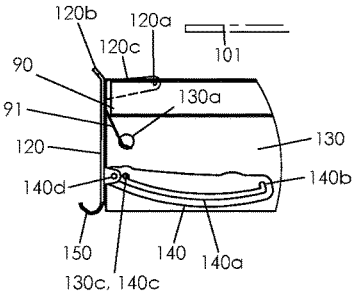
FIG. 23 is a detail elevation view of an upper drawer with stowed leaf.
Figure 24:
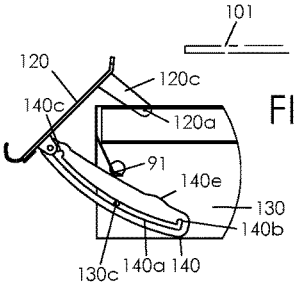
FIG. 24 is the view of FIG. 23 with the face/leaf in a transitory position.
Figure 25:
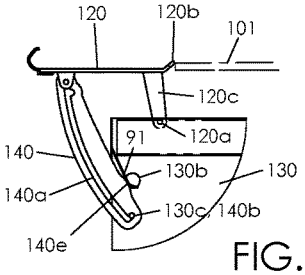
FIG. 25 is the view of FIG. 23 with the leaf deployed.

The exemplary tool chest has four drawers, a top drawer 130, two shorter middle drawers 131, and a lower drawer 132. Other drawer quantities, sizes or arrangements may be used. FIGS. 23 to 25 show details of the exemplary top drawer. In FIG. 23 face/leaf 120 is in the stowed position with face/leaf 120 covering and abutting in parallel front panel 130*e* of drawer 130. In FIGS. 25 and 27 the leaf is deployed. In FIG. 27 the leaf is seen at a level near to that of top surface 101. In this manner leaf 120 is an extension of top 101. Preferably as shown the leaf is slightly recessed below the top with a rear edge at sloped or ramped lip 120*b*. Tools can easily slide between leaf 120 and top 101 when drawer 130 is closed as shown. However tools and the like can be slippery or round and easily fall off an edge as drawer 120 is opened to move away from top 101 lip. Therefore lip 102*b* keeps tools from rolling off the moving horizontal leaf surface into a widening gap between the leaf and the top.

Leaf 120 pivots about hinges 120*a*, FIG. 24, through hinge arm 120*c*, with the hinges connecting the leaf to sides of drawer 130. Hinge arm 120*c* is elongated as shown to extend a length corresponding to the distance between a top of drawer 130 and cabinet top 101. For example as shown hinge arm is at least 80% of this distance. Hinge 120*a* is set back from the front of drawer 130, FIG. 23, to enable the abutting stowage shown while rising substantially above a top of drawer 130 when deployed. This geometry is similar to that discussed above regarding dimensions D1 and D2 in FIGS. 4 and 8. However D1 may be less by the vertical extent of lip 102*b* to allow for the recessed position of leaf 120 discussed above.

In contrast to a top drawer, the lower drawer face/leaves normally have a different hinge geometry since these need not be raised to a chest top level. Likewise top leaf 120 may extend at a top level of drawer 130, but not higher to match top 101. For middle drawer 131 hinge arm 121*c*, FIG. 30A, is preferably substantially shorter than hinge arm 120*c* so that deployed leaf 121 remains near as practical to its associated drawer 131, thus minimizing the height of the assembly and allowing a near full cantilever past the drawer. A small space is seen in FIG. 30A between leaf 121 and a top edge of drawer 131. Hinge arm 121*c* may be of such a length that the deployed leaf is immediately adjacent its drawer with only enough clearance to allow required motion of the leaf.

Figure 26:
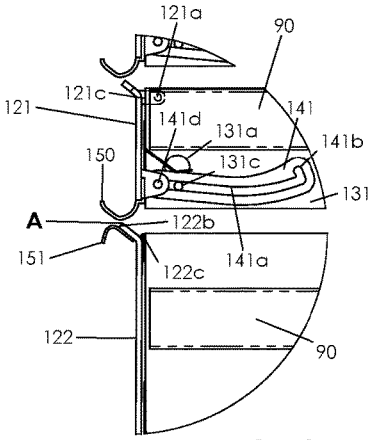
FIG. 26 is a detail elevation view indicating a normal clearance between vertically adjacent leaves.

In FIG. 32 leaf hinge arms 121*c* are inside of the drawer. With hinge arm 121*c* inside the drawer there is room for the full extension slide 90 on the same position outside. In FIG. 31 a front of drawer 131 has slot 131*d*. This slot fits hinge arm 121*c* when the leaf is stowed, FIG. 28A. In general a shallow drawer may have an inside hinge arm with a clearance slot while a tall drawer may have an outside hinge arm without a slot if slide 90 is lower on the drawer side. Another hinge structure is shown in FIGS. 26 and 27. For the exemplary bottom drawer hinge 122*c* is a butt or piano type hinge. This hinge is low cost and can support the face/leaf across its full width (into the page in FIG. 26).

To hold the leaf in the deployed position FIGS. 21 to 31 show leaf stay structures. This structure may also be applied within the scope of the invention for example to the RV style cabinet of the preceding discussion. Similar to the other embodiments disclosed herein the stay provides a torque about the hinge location to resist a force that biases the leaf toward the stowed position, or more generally holds the leaf deployed. In this case the torque is transmitted through compression of the stay to where the stay is attached at a bottom level of the drawer. A torque arm is thus between the drawer/stay attachment and the location of the leaf-to-drawer pivot.

FIGS. 23 to 25 show this structure in operation with upper drawer 130 and exemplary stay 140. Stay 140 preferably operates in compression to hold the leaf deployed. In FIG. 23 stay 140 is hooked, engaged or stabilized on pin 130*c* of the drawer at stay notch 140*c* or equivalent structures. With the pin and notch engaged as a detent the weight of or bias on stay 140 holds leaf 120 in the stowed position when drawer 130 is pulled outward from the tool chest by flange or handle 150. When it is desired to open leaf 120 stay 140 is pressed upward to rotate about pivot 140*d* so notch 140*c* moves away from pin 130*c*. The leaf is free to slide on slot 140*a* about pin 130*c* to the transitional position of FIG. 24. Continuing to rotate leaf 120 to the deployed position moves the stay to the extended position of FIG. 25. The stay then falls onto pin 130*c* at rear notch 140*b*. Rear notch 140*b* normally holds through a detent action. The stay will hold its position by gravity, but it preferably also is held by a resilient biasing member 91. See also FIGS. 31 and 32 for equivalent structures. Biasing member or spring 91 causes a snap fit to securely and selectively hold the stay when it moves to the deployed position at pin 130*c*. Stay 140 may include hump 140*e* so that stay 140 engages spring 91 only in the deployed position of FIG. 25. Compare FIGS. 23 and 24 where spring 91 is spaced from stay 140. In this manner stay 140 moves freely with leaf 120 for most of the possible motion of the leaf. Therefore spring 91 engages only where the engagement is useful at the end deployed position. To stow the leaf stay 140 is pushed upward to disengage the detent at notch 140*b*. Stay 140 and leaf 120 are then free to move from the position of FIG. 25 to that of FIG. 23.

If notch 140*c* is shallow, or not present as seen in equivalent stay structure 141, FIG. 26, then the leaf 121 in this example can be deployed by simple pulling. The stay resists motion to an extent, note the downward angle of the engaging edge of stay 141. Pin 131*c* slides with enough friction in slot 141*a* to enable opening of the drawer by handle 150 without the leaf opening instead. The stay in this example does not have an immobilizing detent retainer described above that requires the second action of pressing upward or other action on the stay to release the leaf. It may be preferred to use the friction holding method for shorter drawers and/or an at least partial detent for larger drawers corresponding to the respective forces involved. In any case, when it is desired to deploy the leaf, a rotational motion is applied to the leaf once the stay is able to move. For example pulling on handle 150 while pressing on lip 120 with a same hand will cause the leaf to rotate upward.

Slot 140*a* is preferably curved as shown. In this manner stay 140 does not go below, or too far below, a bottom of drawer 130 through its motion, FIG. 24. Further a curved slot allows the stay to fit under slide 90 without interference there from. This clearance is especially applicable to a shallow drawer such as drawers 131, FIGS. 26, 31 and 32, where drawer side wall height is limited. As seen in these views hinge pivot 121*a* is vertically at or adjacent a top of slide 90 while stay 141 fits compactly under slide 90 for the various positions of the stay. These positions include an elongated position substantially parallel to the slide when stowed, FIG. 26 and an angled relation in front, below, and near a front corner of slide 90 when deployed, FIGS. 31 and 32.

With the structures shown in exemplary FIGS. 30 to 32 a holding torque is applied to deployed leaf 121 between hinge pivot 121*a* at or adjacent a top of drawer 131 and pin

131*c* below slide 90 near a bottom of the drawer, with a resulting torque arm extending from a top of the drawer to near a bottom or bottom level of the drawer. An effective rigid triangle has vertices at the leaf spaced away from the drawer, (141*d*) the top front of the drawer, (121*a*), and the bottom front of the drawer (131*c*). The torque arm length is between pin 131*c* and hinge 121*c*. The arm is long enough to securely support the deployed leaf while allowing space for slide 90 and remaining compact in its modes of operation. This torque arm arrangement also applies for example to the drawer of FIG. 15 between pivot 28*d* and knob 41.

In the exemplary tool chest drawers of three heights are shown. Top drawer 130 is a medium height, being about 4 inches high. Middle drawers 131 are about 2 inches high or less, while bottom drawer 132 is about 6 inches high. Of course other heights, shapes and styles may be used in various positions on the tool chest. Middle drawers 131 have associated parts of stay 141 pivoting on pivot 141*d*, slot 141*a* slidably engaging pin 131*c*, the slot terminating at rear notch 141*b*, and leaf 121 with lip 121*b*. Bottom drawer 132 is shown with corresponding stay 142 and leaf 122 and exemplary front panel 132*e*. The respective parts between drawers are normally equivalent but include variations to provide for the different heights and the detent notches 140*c* and 142*c*.

When a leaf is deployed any tools thereon may interfere with the path of a next higher drawer as it opens. A user could clear the tools from the leaf first. However it is more convenient if the tools can remain in place. For this function the leaf selectively engages the higher drawer so that the deployed leaf, rather than the tools, is in the path of the higher drawer. Most generally a link between drawers is dependent on the position of a leaf of an adjacent or vertically adjacent drawer. More specifically this action is illustrated in FIGS. 28 to 30A. FIG. 28 shows a lower middle drawer 131 with a leaf deployed. In the detail at FIG. 28A higher face/leaf 121 is stowed and abuts substantially in parallel drawer front 131*e*, for example with space only for a thickness of an extrusion of handle 150. Leaf lip 121*b* of the lower adjacent drawer contacts handle 150 of the higher drawer 131 at location B. In FIG. 30A the higher drawer has its leaf deployed and a similar contact occurs at C between lip 121*b* and the now exposed front 131*e* of higher drawer 131. Therefore the engagement between vertically adjacent drawers occurs for either position of the higher leaf. When the higher drawer is opened as seen in FIGS. 30 and 30A the lower drawer will be pulled out with it because of the engagement at B or C. As seen in FIG. 30 the contents of the higher drawer 131 are now accessible while the leaf of the lower drawer remains uncovered, undisturbed and accessible. The higher leaf may be stowed rather than deployed; the effect on the lower leaf will be the same. Both drawers may be moved back into the tool chest cabinet simply by pushing the lower drawer back in. Or only the higher drawer is moved back to expose for access the contents of the lower drawer.

In FIGS. 26 and 27 face/leaf 122 pivots upon drawer 132 at the butt or piano hinge 122*c* as discussed above. In the deployed position lip 122*b* is closer vertically to a top of drawer 132 that the respective lips of the others drawers shown. This is a result of the positions of the hinge and mated parts. As a result the type of path blocking C shown in FIG. 30A may not occur. Specifically lip 122*b* may not intercept the front panel of the next above drawer 131 if its respective face/leaf 121 were deployed. Optionally lip 122*b* may extend higher in FIG. 27. As shown face/leaf 122 includes upper handle 151. This handle provides an interface to pull drawer 132 outward while face/leaf 122 has no bias to rotate upward as can occur when pulling upon handle 150. This optional interface can operate with or instead of the function discussed above for notches 140*c* and similarly 142*c*, with such notches holding the face/leaf stowed as handle 150 is pulled. Upper handle 151 further provides path blocking against either next-above handle 150 or drawer 131, depending whether the respective above leaf is deployed.

As seen in FIG. 28A lower-middle drawer 131 is partly outward in its leaf support position to provide space for lip 121*b* and handle 150. Optionally lip 121*b* and handle 150 may be configured or removed whereby drawer 131 remains near or at fully inward while the leaf is deployed.

In FIG. 32 sidewall opening 131*a* provides a space for tab 91*a* to extend into an outer face of drawer 131. With tab 91*a*, spring 91 extends past both faces and past a thickness, of stay 141 and will reliably ride atop an edge of stay 141. At the same time the spring does not extend past a thickness of slide 90, out of the page in FIG. 26. More generally the various parts of the deployable leaf add only negligibly to the size of the drawer assembly. A width of the drawer, out of the page in the side views, is not affected at all by the presence of the stay, leaf, spring or other parts. The depth, sideways in the side views, is increased only by the minimal thickness of the leaf material. In the case of a tool chest this is normally steel and will be less than 0.10 inch.

As discussed above with respect to the RV style cabinet, a face/leaf of the tool chest drawer stows in parallel abutment with a closed front panel of the drawer. There are effectively two adjacent layers, a face/leaf and a drawer front, with no usable space there between. In this way the leaf can be stowed with negligible added bulk to the drawer assembly. As disclosed a majority of an area of the deployed leaf cantilevers outward beyond the front face of the drawer. The front drawer face remains fixed in its normal position whereby a fully normal and functional drawer is present for any position of the leaf attached to it. This contrasts with the leaf/face also being a single layer drawer front whereby the drawer contents would be exposed at front when the leaf is deployed. However it is an option to have the drawer assembly configured in this manner.

In the deployable leaf structures discussed above a leaf is pivotally attached to the drawer and stabilized or fixed by a secondary member that is selectively attached to the drawer at a separate and spaced location of the drawer. A positive latch holds the leaf extended in cantilever from the drawer front panel. Examples of the positive latch are detent 30*a*, FIG. 2, knob 41, FIG. 19, and pin 130*c*, FIG. 25. A drawer leaf immediately under a cabinet top surface may deploy to a same or near same level as the cabinet top to become an extension or enlargement of the top surface. Lower level drawers may include respective leaves to form "balconies" along a front side of the tool chest or other cabinet. In a similar way that apartment balconies let in sunlight to each level the balconies of the tool chest provide access to each. A leaf normally extends about a same distance as an attached drawer is high, this being since the leaf covers the drawer front. The leaf may be smaller, or it may be larger as in FIGS. 15 to 19. In this larger case the leaf extends the same distance as the two associated drawers are high together. The drawer leaves disclosed herein are pivotally attached to the drawers. Thus the leaves are slidably attached or mounted to the cabinet through the drawers and, while deployed, extend outward from both a drawer front and the cabinet for all drawer positions. In a variation a drawer may be pivotally mounted to a cabinet, for example about a vertical axis, with such drawer fitted with a leaf of the invention.

In the illustrated embodiments the deployed leaf is hinged at or near a top of its associated drawer. The deployed leaf is at a level near or above a top of the drawer. Optionally the leaf may be hinged near a bottom front of the drawer and deploy at a level near a bottom of the drawer. The front panel effectively becomes an upward extending divider between the leaf and drawer box. This option may be used when desired. A trade off in this case is such a leaf cannot normally serve as a same-level extension of the countertop. Also its usable horizontal area is limited to that which extends beyond the drawer front. In contrast a top level extension may include area that overlays rearward a front panel or area of the drawer.

While the particular forms of the invention have been illustrated and described, it will be apparent that various modifications can be made without departing from the spirit and scope of the invention. It is contemplated that elements from one embodiment may be combined or substituted with elements from another embodiment.

What is claimed is:

1. A cabinet including a drawer movably mounted thereto comprising: a cabinet top surface, an interior of the cabinet below the top surface, and a front of the cabinet; the drawer having an inward position within the cabinet and an outward position extended from the front of the cabinet; said drawer in an assembly including said drawer with a drawer box, the drawer box including a front panel that bounds the drawer box from a front side of the drawer; a face/leaf element at a front of the drawer, the face/leaf element being separate from the front panel; the face/leaf element pivotally attached to the drawer including a stowed position abutting the front panel of the drawer and a horizontal deployed position, the face/leaf element transforming into a leaf that extends outward from the drawer and the cabinet when the face/leaf element is rotated to a leaf deployed position; and a majority of a leaf area being cantilevered beyond the front panel of the drawer in the deployed position; and the deployed position leaf includes a top of the leaf substantially co-planar to the cabinet top surface.

2. The cabinet of claim 1 wherein the face/leaf element is attached to the drawer through an elongated hinge arm including a pivot at one end of the arm and a face of the face/leaf element at another end of the arm, the pivot is spaced a first perpendicular distance from the face, and the pivot is spaced a second perpendicular distance from the top surface, the first and second distances being near the same.

3. The cabinet of claim 1 wherein at least 80 percent of the leaf area is exposed upward without blockage from the drawer or from a countertop.

4. The cabinet of claim 3 wherein the entire leaf area is exposed upward without blockage from the drawer or countertop.

5. The cabinet of claim 1 wherein a holding structure extends from a pivot location of a hinge arm to a catch, the pivot location being between the drawer and the leaf, a distance between the pivot location and the catch being a torque arm of the holding structure available to hold the leaf in the deployed position.

6. The cabinet of claim 1 wherein the drawer is a first drawer, a second drawer is vertically adjacent and below the first drawer, the face/leaf element stowed position includes the face/leaf element covering a front of both drawers.

7. The cabinet of claim 1 wherein the front panel is covered by the face/leaf element in the stowed position and the front panel is exposed frontward in the deployed position, the front panel bounding the drawer box in each of the stowed and deployed positions.

8. The cabinet of claim 1 wherein a rear edge of the deployed position leaf overlays the drawer rearward of the drawer front panel and the rear edge abuts the front of the cabinet to cause the drawer to partly extend outward in a drawer leaf support position.

9. The cabinet of claim 8 wherein a cam action coordinates face/leaf deployment motion to drawer motion whereby as the face/leaf rotates about the drawer the face/leaf also slides along a front of the cabinet to translate the drawer to the drawer leaf support position.

10. A cabinet including a drawer slidably mounted thereto comprising: a cabinet interior, and a cabinet front; the drawer having an inward position within the cabinet and an outward position extended from the cabinet front; said drawer in an assembly including said drawer with a drawer box, the drawer box including a front panel that bounds the drawer box from a front side of the drawer; a face/leaf element at a front of the drawer, the face/leaf element being separate from the front panel; the face/leaf element pivotally attached to the drawer at a pivot location at a top of the drawer including a stowed position abutting the front panel of the drawer and a horizontal deployed position, the face/leaf element transforming into a leaf near a top of the drawer when the face/leaf element is rotated to a leaf deployed position to extend outward beyond the drawer and the cabinet front; the deployed leaf forming an upwardly exposed horizontal surface, the leaf moving along with the drawer between the drawer inward position and drawer outward position, the inward position including the leaf abutting the cabinet front, the outward position including a leaf rear edge moved away to be spaced from the cabinet front; and a stay extends between the deployed leaf and a drawer/stay attachment location near a bottom level of the drawer, a torque arm extending from the drawer/stay attachment location to the leaf-to-drawer pivot location.

11. The cabinet of claim 10 wherein a spacing of the moved away rear edge is a same distance as a distance the drawer has moved outward.

12. The cabinet of claim 10 wherein the stay comprises a holding structure body that extends from the pivot location to a catch, a distance between the pivot location and the catch being a torque arm of the holding structure available to hold the leaf in the deployed position.

13. A cabinet including a drawer slidably mounted thereto comprising: a cabinet interior, and a cabinet front the drawer having an inward position within the cabinet and an outward position extended from the cabinet front said drawer in an assembly including said drawer with a drawer box, the drawer box including a front panel that bounds the drawer box from a front side of the drawer; a face/leaf element at a front of the drawer, the face/leaf element being separate from the front panel; the face/leaf element pivotally attached to the drawer at a pivot location at a top of the drawer including a stowed face/leaf element position abutting the front panel of the drawer and a horizontal deployed face/leaf element position, the face/leaf element transforming into a leaf near a top of the drawer when the face/leaf element is rotated to a leaf deployed position to extend outward beyond the drawer and the cabinet front the deployed leaf forming an upwardly exposed horizontal surface, the leaf moving along with the drawer between the drawer inward position and drawer outward position, the inward position including the leaf abutting the cabinet front, the outward position including a leaf rear edge moved away to be spaced from the cabinet front; and a holding structure body extends from the pivot location to a catch, a distance between the pivot location and the catch being a torque arm of the holding structure available to hold the leaf in the deployed position.

14. The cabinet assembly of claim 13 wherein the deployed leaf element is entirely exposed upward beyond the cabinet and the leaf is slidably mounted to the cabinet through the drawer.

15. The cabinet of claim 13 wherein the drawer is a first drawer, a second drawer is vertically adjacent and below the first drawer, and the stowed leaf element abuts a front panel of both the first and second drawers.

16. The cabinet of claim 13 wherein the drawer is a first drawer, a second drawer is vertically adjacent and above the first drawer and the deployed leaf element lies in the path of the second drawer whereby the first drawer is forced to open when the second drawer is opened.

17. The cabinet of claim 13 wherein a top surface of the deployed leaf is recessed with respect to the front edge and rear edge of said top surface, including an upward lip at the rear edge of the leaf.

18. The cabinet of claim 13 wherein the deployed leaf extends outward at a level above a front panel of the drawer box.

* * * * *